US010012931B2

(12) United States Patent
Yada

(10) Patent No.: US 10,012,931 B2
(45) Date of Patent: Jul. 3, 2018

(54) IMAGE FORMING APPARATUS, METHOD FOR CONTROLLING FIXING DEVICE AND STORAGE MEDIUM

(71) Applicant: Brother Kogyo Kabushiki Kaisha, Nagoya-shi, Aichi-ken (JP)

(72) Inventor: Naoya Yada, Kuwana (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/223,019

(22) Filed: Jul. 29, 2016

(65) Prior Publication Data

US 2017/0031278 A1 Feb. 2, 2017

(30) Foreign Application Priority Data

Jul. 29, 2015 (JP) ..... 2015-149432

(51) Int. Cl.
*G03G 15/20* (2006.01)

(52) U.S. Cl.
CPC . *G03G 15/2039* (2013.01); *G03G 2215/2035* (2013.01)

(58) Field of Classification Search
CPC ..... G03G 15/2039; G03G 2215/2035
See application file for complete search history.

(56) References Cited

U.S. PATENT DOCUMENTS 4,603,245 A * 7/1986 Yagasaki ..... G03G 15/2039 219/216
5,040,022 A * 8/1991 Kinoshita ..... G03G 15/2003 399/70
5,287,155 A * 2/1994 Arai ..... G03G 15/205 219/216
5,412,453 A * 5/1995 Matsuo ..... G03G 15/2039 399/33
5,659,844 A * 8/1997 Fujiwara ..... G03G 15/2064 399/328
5,669,038 A * 9/1997 Kishimoto ..... G03G 15/2003 219/216

(Continued)

FOREIGN PATENT DOCUMENTS

JP 2001-142544 A 5/2001
JP 2009-237070 A 10/2009

*Primary Examiner* — David Bolduc
(74) *Attorney, Agent, or Firm* — Banner & Witcoff, Ltd.

(57) ABSTRACT

An image forming apparatus including: a fixing device including a heater and a temperature sensor, and a controller configured to execute: first heater control processing including: first processing of driving the heater with a predetermined energization ratio for a first time period independently of the detected temperature of the temperature sensor; second processing of stopping the driving of the heater for a second time period independently of the detected temperature of the temperature sensor; the second processing being executed when the first processing has ended, comparison processing of comparing a detected temperature of the temperature sensor with a reference temperature, which is executed when the second processing has ended; and first determination processing of determining whether to execute the first processing again based on the result of the comparison processing which has been executed when the second processing had ended.

16 Claims, 10 Drawing Sheets

(56) References Cited

U.S. PATENT DOCUMENTS

| | | | | |
|---|---|---|---|---|
| 5,682,577 | A * | 10/1997 | Kiyoi | G03G 15/2003 219/494 |
| 5,701,554 | A * | 12/1997 | Tanaka | G03G 15/2039 399/69 |
| 6,847,793 | B2 * | 1/2005 | Suzuki | G03G 15/2039 219/216 |
| 8,036,558 | B2 | 10/2011 | Nakashima | |
| 2006/0115289 | A1 * | 6/2006 | Umezawa | G03G 15/2039 399/69 |
| 2008/0019722 | A1 * | 1/2008 | Ota | G03G 15/2039 399/69 |
| 2009/0245846 | A1 | 10/2009 | Nakashima | |

* cited by examiner

IMAGE FORMING APPARATUS, METHOD FOR CONTROLLING FIXING DEVICE AND STORAGE MEDIUM

CROSS-REFERENCE TO RELATED APPLICATIONS

This application claims priority from Japanese Patent Application No. 2015-149432 filed on Jul. 29, 2015, the entire contents of which are incorporated herein by reference.

TECHNICAL FIELD

The technology of the disclosure relates to an image forming apparatus, a method for controlling a fixing device, and a storage medium storing a program.

BACKGROUND

An image forming apparatus has been known which has a fixing device including a heater and a temperature sensor and is configured to control a temperature of the heater on the basis of a signal from the temperature sensor. Specifically, the image forming apparatus is configured to execute control (hereinafter, referred to as "on-off temperature control of the healer") of continuing to energize the heater for a time period in which a detected temperature acquired on the basis of the signal from the temperature sensor is equal to or lower than a reference temperature and continuing to stop the energization of the heater for a time period in which the detected temperature exceeds the reference temperature.

For example, in IEC/EN61000-3-3 that is a standard of a flicker, as an index of the flicker, a flicker value (a short-term flicker value (Pst, a long-term flicker value (Plt)) indicative of a periodic voltage change, a maximum relative voltage change (dmax) indicative of an instantaneous voltage change due to inrush current, and the like are exemplified. In the on-off temperature control of the heater, an undershoot situation that the detected temperature considerably falls short of the reference temperature due to a delay (hereinafter, referred to as "temperature delay") of the detected temperature with respect to an actual temperature such as a response delay of the temperature sensor occurs. For this reason, the temperature of the heater greatly varies, so that current to be output from the heater considerably changes. As a result, particularly, the maximum relative voltage change (dmax) may not be reduced.

SUMMARY

Aspects of the disclosure provide a technology capable of solving the above problem.

According to an aspect of the disclosure, there is provided an image forming apparatus including: a fixing device including a heater and a temperature sensor, and a controller configured to execute: first heater control processing including: first processing of driving the heater with a predetermined energization ratio for a first time period independently of the detected temperature of the temperature sensor; second processing of stopping the driving of the heater for a second time period independently of the detected temperature of the temperature sensor, the second processing being executed when the first processing has ended; comparison processing of comparing a detected temperature of the temperature sensor with a reference temperature, which is executed when the second processing has ended; and first determination processing of determining whether to execute the first processing again based on the result of the comparison processing which has been executed when the second processing had ended.

Here, "independently of the detected temperature of the temperature sensor" means "irrespective of the detected temperature of the temperature sensor", and may include, for example, "irrespective of a difference between the detected temperature of the temperature sensor and the reference temperature". However, the disclosure is not limited thereto.

According to another aspect of the disclosure, there is provided a method for controlling a fixing device including a heater and a temperature sensor, the method including: first heater control processing including: first processing of driving the heater with a predetermined energization ratio for a first time period independently of the detected temperature of the temperature sensor; second processing of stopping the driving of the heater for a second time period independently of the detected temperature of the temperature sensor, the second processing being executed when the first processing has ended; comparison processing of comparing a detected temperature of the temperature sensor with a reference temperature, which is executed when the second processing has ended; and first determination processing of determining whether to execute the first processing again based on the result of the comparison processing which has been executed when the second processing had ended.

According to another aspect of the disclosure, there is provided a non-transitory computer readable storage medium storing a program, when executed by a computer of an image forming apparatus including a fixing device including a heater and a temperature sensor, causing the image forming apparatus to perform operations including: first heater control processing including: first processing of driving the heater with a predetermined energization ratio for a first time period independently of the detected temperature of the temperature sensor; second processing of stopping the driving of the heater for a second time period independently of the detected temperature of the temperature sensor, the second processing being executed when the first processing has ended; comparison processing of comparing a detected temperature of the temperature sensor with a reference temperature, which is executed when the second processing has ended; and first determination processing of determining whether to execute the first processing again based on the result of the comparison processing which has been executed when the second processing had ended.

DETAILED DESCRIPTION

Figure 1:
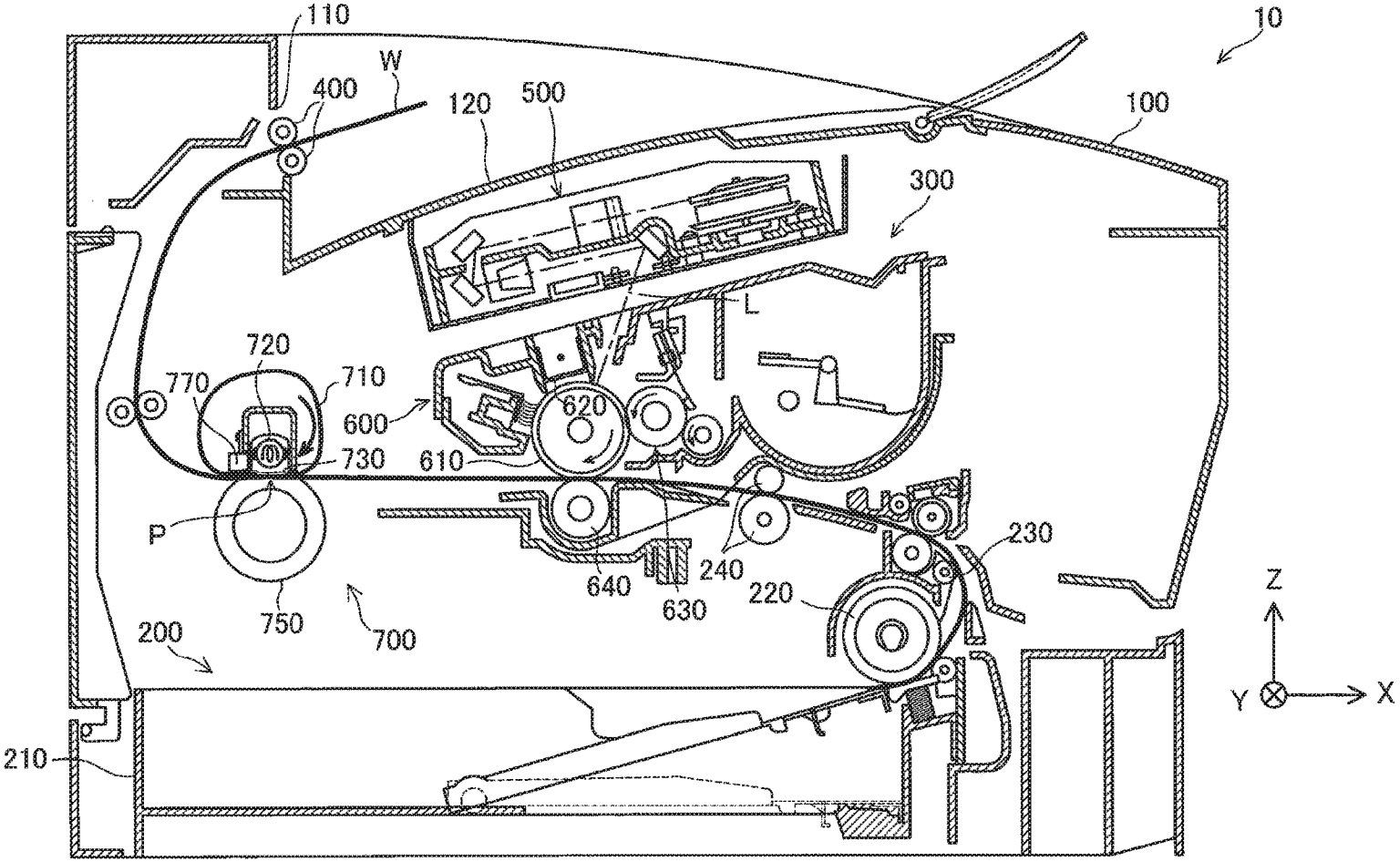
FIG. 1 is a schematic view depicting an overall configuration of a printer 10 in accordance with an illustrative embodiment.

A printer 10 of an illustrative embodiment will be described with reference to FIGS. 1 to 9. FIG. 1 is a schematic view depicting an overall configuration of the printer 10. In FIG. 1, XYZ axes orthogonal to each other and provided to specify directions are shown. In the specification, for convenience, a positive direction of Z axis is referred to as 'upper direction,' a negative direction of Z axis is referred to as 'lower direction,' a positive direction of X axis is referred to as 'front direction,' a negative direction of X axis is referred to as 'rear direction,' a positive direction of Y axis is referred to as 'right direction' and a negative direction of Y axis is referred to as 'left direction.' This applies to FIG. 2 and thereafter too.

The printer 10 is a monochrome laser printer, and has a housing 100, a feeder unit 200, an image forming unit 300 and discharge rollers 400. The housing 100 is formed with on its upper surface with a discharge opening 110 and a discharge tray 120. In the meantime, the printer 10 is an example of the image forming apparatus.

The feeder unit 200 is provided in the housing 100, and has a tray 210, a pickup roller 220, a conveying roller 230 and registration rollers 240. The tray 210 is an accommodation unit configured to accommodate therein sheets W. The sheets \V accommodated in the tray 210 are picked up one by one from a discharge position of the tray 210 by the pickup roller 220, which is then conveyed by the conveying roller 230, is posture-corrected by the registration rollers 240 and is delivered to the image forming unit 300 at predetermined timing.

The image forming unit 300 is provided in the housing 100, and has an exposure unit 500, a process unit 600 and a fixing unit 700. The exposure unit 500 is configured to illuminate laser light L toward a photosensitive member 610 (which will be described later).

The process unit 600 has a photosensitive member 610, a charger unit 620, a developing unit 630 and a transfer roller 640. The photosensitive member 610 is a drum-shaped member configured to rotate about an axis thereof. The charger unit 620 is disposed to face toward a surface of the photosensitive member 610, and is configured to uniformly charge the surface of the photosensitive member 610. The developing unit 630 is configured to accommodate therein developer (toner) and to supply the developer to the surface of the photosensitive member 610. The transfer roller 640 is disposed to face toward the photosensitive member 610 and a transfer bias is applied thereto.

When the laser light L from the exposure unit 500 is illuminated to the surface of the photosensitive member 610 uniformly charged by the charger unit 620, an electrostatic latent image is formed on the surface of the photosensitive member 610. When the developer is supplied to the surface of the photosensitive member 610 by the developing unit 630, the electrostatic latent image formed on the surface of the photosensitive member 610 is developed and a developer image is thus formed. When the transfer bias is applied to the transfer roller 640, the developer image formed on the surface of the photosensitive member 610 is transferred onto the sheet W passing through a position of the transfer roller 640.

The fixing unit 700 is disposed at a more downstream side than the photosensitive member 610 of the process unit 600 with respect to a conveying direction of the sheet W by the registration rollers 240, and has a fixing belt 710, a halogen heater 720, a nip member 730, a pressing roller 750, and a thermistor 770. The fixing belt 710 is a cylinder-shaped belt and is provided to be rotatable, and guide members not shown are provided at both axial end portions thereof. The halogen heater 720 is a heat generation member configured to drive by an alternating current power supply ACS (refer to FIG. 2), and is disposed near the fixing belt 710. The pressing roller 750 is disposed to face toward the fixing belt 710, and is in contact with the fixing belt 710 and the guide members provided at both end portions of the fixing belt 710. When the pressing roller 750 is rotated by a motor driving unit 910 (which will be described later), the fixing belt 710 is rotated via the guide members. The nip member 730 is a metal plate and is configured to sandwich the fixing belt 710 between the nip member and the pressing roller 750. A nip portion P is formed between the fixing belt 710 and the pressing roller 750. The thermistor 770 is disposed to face toward a part of the nip member 730, and is configured to output a temperature signal Sa corresponding to a temperature of the nip member 730 toward a controller 800 (refer to FIG. 2). In the meantime, the fixing belt 710 is an example of the roller, the halogen heater 720 is an example of the heater, and the thermistor 770 is an example of the temperature sensor.

When the halogen heater 720 is driven by the alternating current power supply ACS and thus generates heat, the fixing belt 710 is heated by the halogen heater 720, so that a temperature of the fixing belt 710 increases. Also, when the fixing belt 710 is rotated, the pressing roller 750 is correspondingly rotated. When the sheet W having passed through the process unit 600 reaches a position (nip portion P) between the fixing belt 710 and the pressing roller 750, the sheet is heated by the fixing belt 710 with being conveyed by the fixing belt 710 and the pressing roller 750. Thereby, the developer image formed on a surface of the sheet W is heat-fixed.

The discharge rollers 400 are rollers configured to discharge the sheet W having passed through the fixing unit 700 to the discharge tray 120 through a discharge opening 110.

Figure 2:
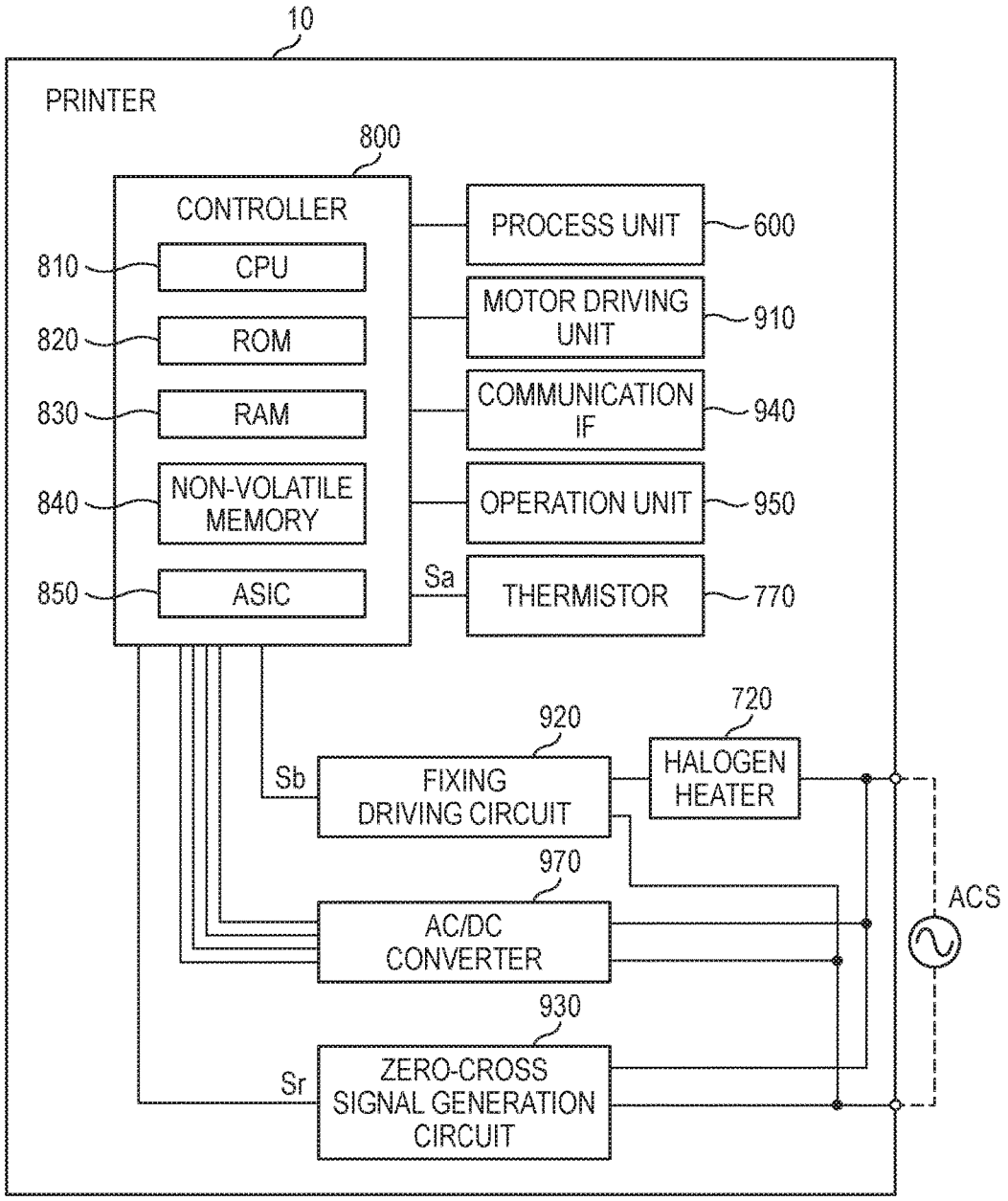
FIG. 2 is a block diagram depicting an electrical configuration of the printer 10.

FIG. 2 is a block diagram depicting an electrical configuration of the printer 10. The printer 10 has a controller 800, a motor driving unit 910, a fixing driving circuit 920, a zero-cross signal generation circuit 930, a communication interface (IF) 940, an operation unit 950, and an AC/DC converter 970, in addition to the process unit 600, the halogen heater 720, the thermistor 770 and the like The controller 800 has a CPU 810, a ROM 820, a RAM 830, a non-volatile memory 840, and an ASIC (Application Specific Integrated Circuit) 850. In the ROM 820, a program for controlling the printer 10, a variety of setting information, and the like are stored. The RAM 830 is used as a work area when the CPU 810 executes a variety of programs, or a temporary storage area of data. The non-volatile memory 840 is a rewritable memory such as an NVRAM, a flash memory, an HDD, an EEPROM or the like. The ASIC 850 is a hardware circuit for image processing and the like. The CPU 810 is configured to control the respective constitutional elements of the printer 10 in accordance with the control program read from the ROM 820 and signals transmitted from diverse sensors. The controller 800 or the CPU 810 and the fixing driving circuit 920 are examples of the controller.

The motor driving unit 910 has one or more motors (not shown), and is configured to rotate the pickup roller 220, the registration rollers 240, the photosensitive member 610, the fixing belt 710 and the like by driving forces of the motors. The communication interface 940 is a hardware element for enabling communication with an external device. The operation unit 950 has a variety of buttons and a touch panel (all of which are not shown) configured to receive a user's operation. The touch panel is also configured to function as a display unit for displaying diverse information. The AC/DC converter 970 is configured to convert alternating current power from the alternating current power supply ACS connected to the printer 10 into direct current power and to supply the same to the respective units of the printer 10.

The zero-cross signal generation circuit 930 generates a zero-cross signal Sr which synchronizes with zero-cross timings ZC (refer to FIG. 3) at which a voltage V of the alternating current power supply ACS becomes zero. The generated zero-cross signal Sr is output to the controller 800. The zero-cross signal Sr is a pulse signal which becomes a low level at peripheral time periods K and becomes a high level at time periods other than the peripheral time periods K. The peripheral time periods K are time periods which are peripheral to the zero-cross timings ZC defined by a threshold value Vt.

Figure 3:
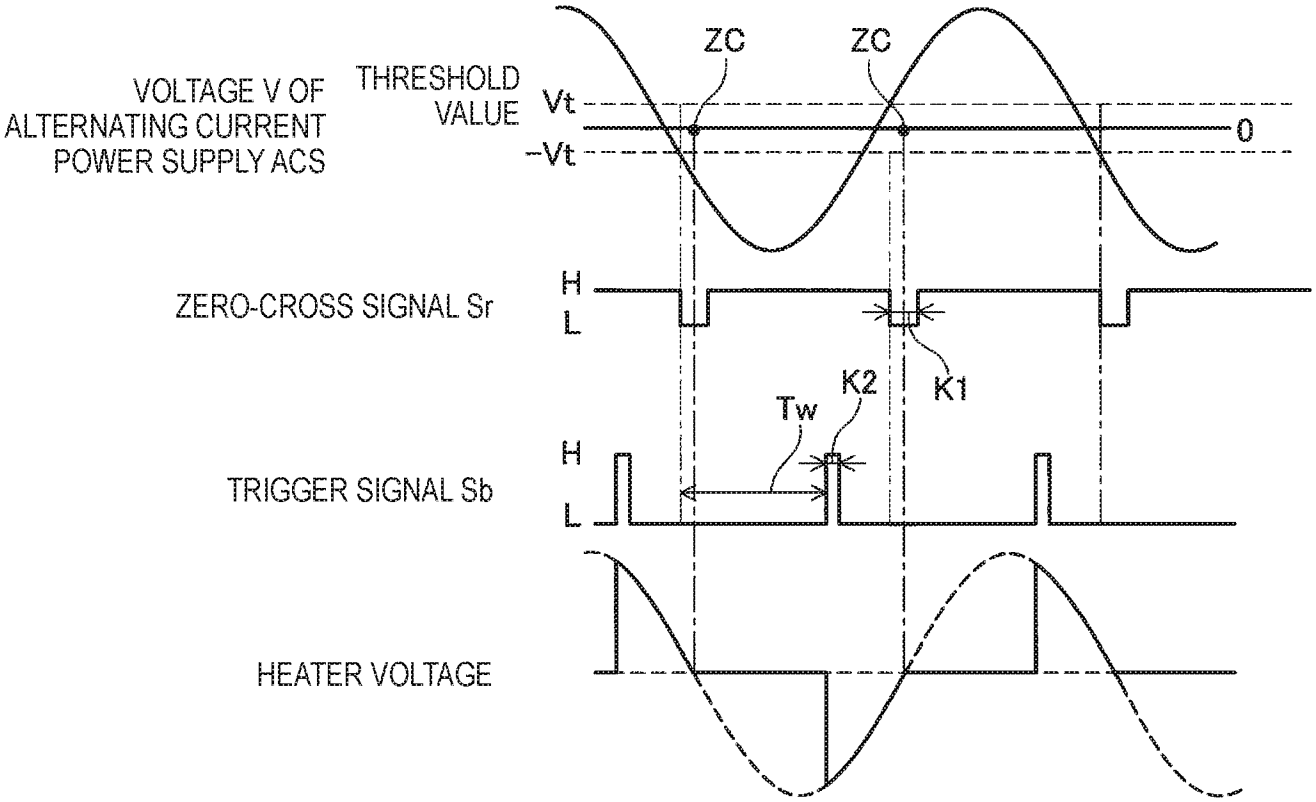
FIG. 3 is a time chart relating to control of a heater.

The controller 800 (refer to FIG. 2) generates a trigger signal Sb by using the zero-cross signal Sr generated by the zero-cross signal generation circuit 930 as a reference. As shown in FIG. 3, for example, the trigger signal Sb is a pulse signal which changes from a low level to a high level at a timing later by an adjustment time period Tw than a timing at which the zero-cross signal Sr Changes from the low level to the high level, maintains the high level for a time period K2, and then changes to the low level. Since, the timings at which the zero-cross signal Sr changes from the low level to the high level synchronize with the zero-cross timings ZC of the alternating current power supply ACS, timings at which the trigger signal Sb changes from the low level to the high level also synchronize with the zero-cross timings ZC of the alternating current power supply ACS. The controller 800 outputs the generated trigger signal Sb to the fixing driving circuit 920.

The fixing driving circuit 920 includes, for example, an energization time adjusting element which is configured by a triac, etc. The fixing driving circuit 920 switches a state between the alternating current power supply ACS and the halogen heater 720 to an energization state at the timings at which the trigger signal Sb changes from the low level to the high level and switches the state between the alternating current power supply ACS and the halogen heater 720 to a non-energization state at the zero-cross timings ZC of the alternating current power supply ACS. Therefore, a voltage applied to the halogen heater 720 (heater voltage) becomes the voltage V of the alternating current power supply ACS during a time period starting from the timing at which the trigger signal Sb changes from the low level to the high level and ending at the nearest zero-cross timing ZC and becomes zero during a time period starting from the zero-cross timing ZC to the nearest timing at which the trigger signal Sb changes from the low level to the high level.

The controller 800 can change a length of the adjustment time period Tw (refer to FIG. 3) when generating the trigger signal Sb by using the zero-cross signal Sr as a reference. By changing the length of the adjustment time period Tw, an energization time of the energization from the alternating current power supply ACS to the halogen heater 720 is also changed. As a result, the temperature of the halogen heater 720 can be adjusted.

Subsequently, processing that is to be executed by the controller 800 (FIG. 2) is described. While the printer 10 is on, the controller 800 periodically determines whether an execution condition of a standby mode is satisfied. The standby mode is a mode where a heater temperature is maintained at a standby temperature (for example, 122° C.) lower than a fixing temperature (for example, 160° C.) at which the developer image formed on the surface of the sheet W is heat-fixed with the rotation of the fixing belt 710 being stopped. The heater temperature is an actual temperature of the halogen heater 720. The execution condition of the standby mode includes a condition that a state where a printing command for forming an image on the sheet W is not received from any of the communication interface 940 and the operation unit 950 continues for a predetermined time period, for example. When it is determined that the execution condition of the standby mode is satisfied, the controller 800 executes standby mode processing.

Figure 4:
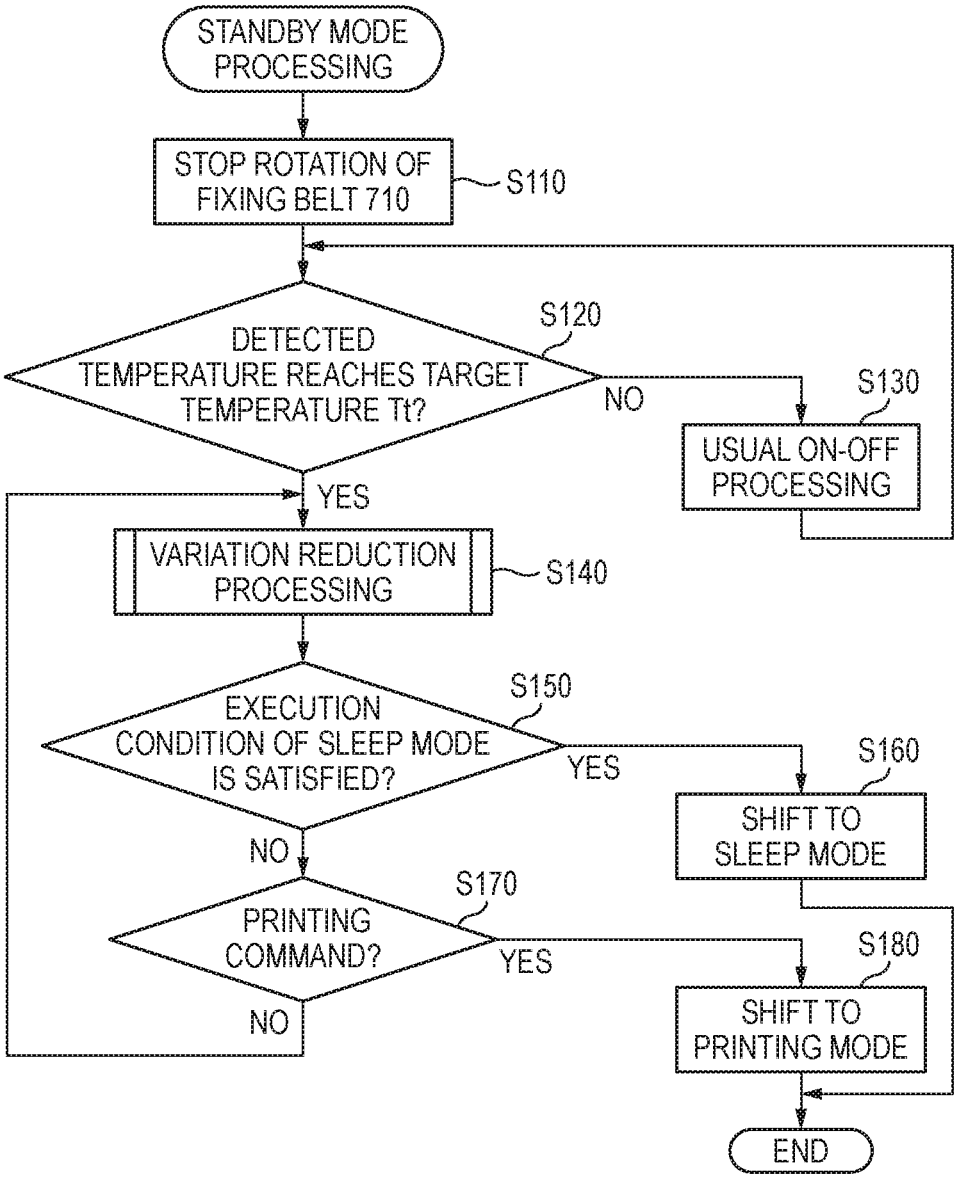
FIG. 4 is a flowchart depicting standby mode processing.

FIG. 4 is a flowchart depicting the standby mode processing. First, the controller 800 enables the motor driving unit 910 to stop the rotation of the fixing belt 710 (S110). Thereby, the fixing belt 710 starts to decelerate. Then, the controller 800 determines whether a detected temperature has reached a target temperature it (S120). In the meantime, the detected temperature is a temperature of the halogen heater 720 that is to be detected by the controller 800 on the basis of the temperature signal Sa from the thermistor 770. The target temperature Tt is set to the standby temperature, in the standby mode. When it is determined that the detected temperature has not reached the target temperature Tt (S120: NO), the controller 800 executes usual on-off processing. (S130). When it is determined that that the detected temperature has reached the target temperature Tt (S120: YES), the controller 800 executes variation reduction processing (S140). That is, for a shift time period after the fixing belt 710 starts to decelerate until the detected temperature reaches the target temperature Tt, the usual on-off control is executed, and after the shift time period elapses, the variation reduction processing is executed. In the meantime, the controller 800 may be configured to determine in S120 whether the fixing belt 710 is at a stationary state and to execute the variation reduction processing on condition that it is determined that the fixing belt 710 is at a stationary state. Thereby, for the shift time period in which the fixing belt 710 shifts from the rotation state to the stationary state, the usual on-off control is executed, and after the shift time period elapses, the variation reduction processing is executed.

The usual on-off processing is processing for executing usual on-off control of setting a larger energization ratio from a plurality of energization ratios having different values when a difference between the detected temperature and the target temperature Tt is larger, and performing energization to the halogen heater 720 with the set energization ratio. In the usual on-off processing, the temperature is detected for every control cycle. The control cycle is, for example, 20 msec. The energization ratio is a duty ratio indicative of a ratio of an energization time period ΔTon (refer to FIGS. 7 and 8), in which the halogen heater 720 is energized, to a predetermined time period. This predetermined time period is a total time period of the energization time period ΔTon and a non-energization time period ΔToff in which the halogen heater 720 is not energized, and is hereinafter referred to as an on-off cycle. The variation reduction processing is processing for executing variation reduction control that is to be described later. In the standby mode, the target temperature Tt is set to the standby temperature. In the meantime, the variation reduction control is an example of the first heater control processing, and the target temperature Tt is an example of the predetermined temperature.

Figure 5:
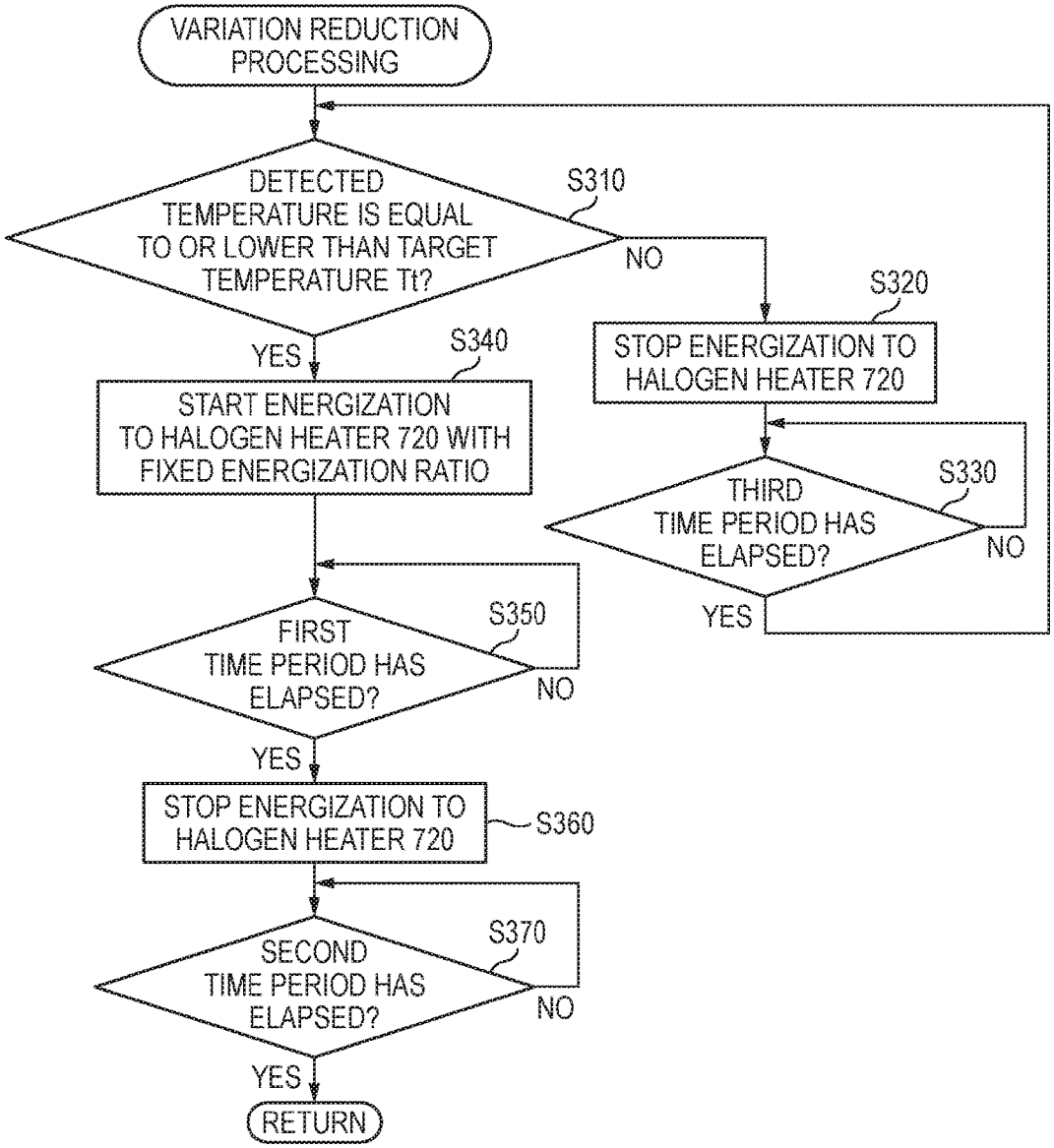
FIG. 5 is a flowchart depicting variation reduction processing.

FIG. 5 is a flowchart depicting the variation reduction processing. The controller 800 first determines whether the detected temperature is equal to or lower than the target temperature Tt (S310). When it is determined that the detected temperature is not equal to or lower than the target temperature Tt, i.e., the detected temperature exceeds the target temperature Tt (S310: NO), the controller 800 stops the energization to the halogen heater 720 (S320), and determines whether a third predetermined time period has elapsed from the stop of the energization (S330). Herein, the stop of the energization to the halogen heater 720 is to switch the halogen heater 720 to a non-energization state for a time period longer than the on-off cycle of the energization ratio, i.e., to set the energization ratio to 0%. Thereby, the halogen heater 720 stops the heat generation operation. Also, the configuration where the controller 800 stops the energization to the halogen heater 720 correctly means that the controller 800 enables the fixing driving circuit 920 to stop the energization to the halogen heater 720. When it is determined that the third time period has not elapsed (S330: NO), the controller 800 stands by as it is, and when it is determined that the third time period has elapsed (S330: YES), the controller 800 returns to S310. That is, while the detected temperature exceeds the target temperature Tt, the halogen heater 720 maintains the stop state of the heat generation operation.

When it is determined in S310 that the detected temperature is equal to or lower than the target temperature Tt (S310: YES), the controller 800 starts to energize the halogen heater 720 with a fixed energization ratio (33%, in this illustrative embodiment) (S340). Herein, the configuration of starting to energize the halogen heater 720 means that the halogen heater 720 is switched to the energization state for at least a part of each on-off cycle of the energization ratio, in other words, the energization to the halogen heater 720 starts with an energization ratio greater than 0%. Thereby, the halogen heater 720 starts the heat generation operation. Also, the configuration where the controller 800 starts to energize the halogen heater 720 correctly means that the controller 800 enables the fixing driving circuit 920 to start the energization to the halogen heater 720.

Then, the controller 800 determines whether a first time period has elapsed from the start of the energization to the halogen heater 720 (S350). The first time period is a time period, which is preset irrespective of the difference between the detected temperature and the target temperature Tt, and is a time period of integer multiple of the on-off cycle, for example. When it is determined that the first time period has not elapsed (S350: NO), the controller 800 continues to energize the halogen heater 720 with the fixed energization ratio, and when it is determined that the First time period has elapsed (S350: YES), the controller 800 stops the energization to the halogen heater 720 (S360). Then, the controller 800 determines whether a second time period has elapsed from the stop of the energization (S370). The second time period is a time period, which is preset irrespective of the difference between the detected temperature and the target temperature Tt, and is a time period longer than the on-off cycle and the third time period, for example. The second time period is an example of the second time period. Also, a total time period of the first time period and the second time period is preferably 0.5 second or longer and 2.0 seconds or shorter.

When it is determined that the second time period has not elapsed (S370: NO), the controller 800 stands by as it is, and when it is determined that the second time period has elapsed (S370: YES), the controller 800 proceeds to S150 of FIG. 4. In S150, the controller 800 determines whether an execution condition of a sleep mode has been satisfied. When it is determined that the execution condition of the sleep mode has been satisfied (S150: YES), the controller 800 executes processing for shifting to the sleep mode (S160), and ends the standby mode processing. The sleep mode is a mode where the energization to the halogen heater 720 is stopped at a stationary state in which the rotation of the fixing belt 710 is stopped. The execution condition of the sleep mode includes a condition that a predetermined sleep reference time period has elapsed from the start of the standby mode, for example. When it is determined in S150 that execution condition of the sleep mode has not been satisfied (S150: NO), the controller 800 determines whether a printing command for forming an image on the sheet W has been received from the communication interface 940 or the operation unit 950 (S170). When it is determined that the printing command has been received (S170: YES), the controller 800 executes processing for shifting to a printing mode (S180), and ends the standby mode processing. The printing mode is a mode of executing image forming processing of controlling the respective units of the printer 10 to form an image on the sheet W.

When it is determined in S170 that the printing command has not been received (S170: NO), the controller 800 returns to S140, and returns to S310 of FIG. 5 to again determine whether the detected temperature is equal to or lower than the target temperature Tt. Like this, in the variation reduction control, when the detected temperature becomes equal to or lower than the target temperature Tt the controller 800 continues to energize the halogen heater 720 with the fixed energization ratio for the first time period, so that the halogen heater 720 continues the heat generation operation for the first time period. The controller 800 continues to stop the energization to the halogen heater 720 at least for the second time period immediately after the first time period is over, so that the halogen heater 720 continues to stop the heat generation operation. After the second time period is over, when the detected temperature is not equal to or lower than the target temperature Tt, the controller 800 further continues to stop the energization to the halogen heater 720, so that the halogen heater 720 continues to stop the heat generation operation beyond the second time period, and when the detected temperature becomes equal to or lower than the target temperature Tt, the controller 800 resumes the energization to the halogen heater 720 at that time.

Figure 6:
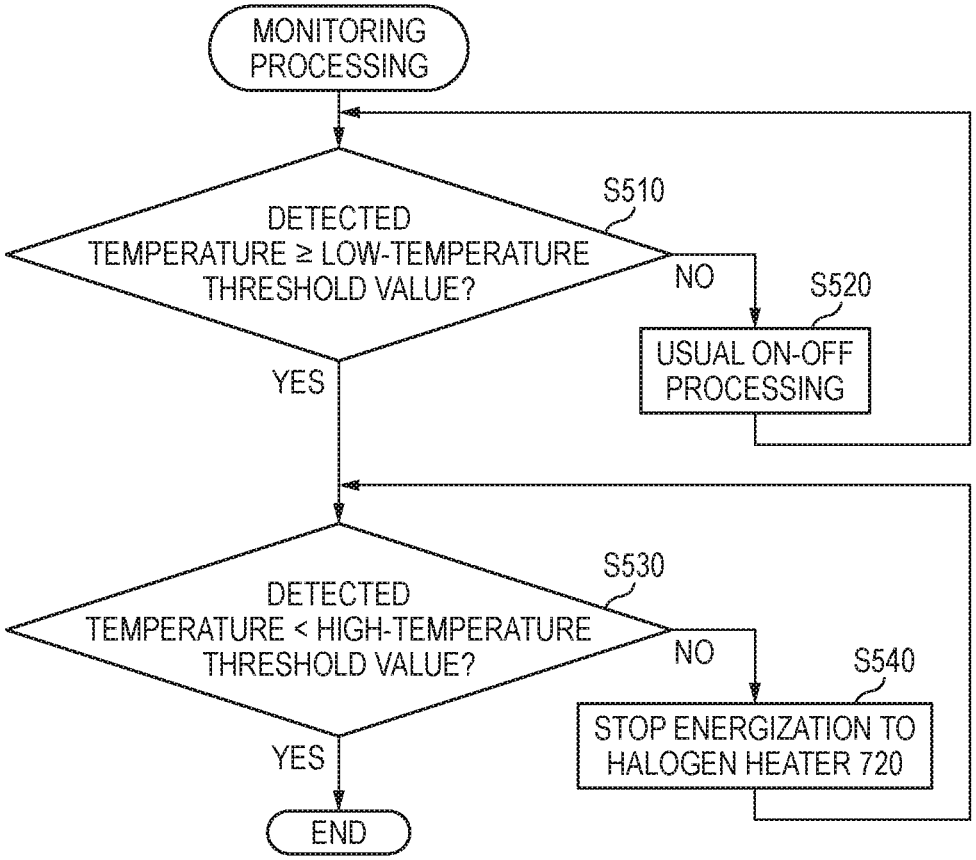
FIG. 6 is a flowchart depicting monitoring processing.

While the printer 10 is on, the controller 800 further periodically executes monitoring processing, in parallel with the standby mode processing. In the meantime, an execution time interval of the monitoring processing is shorter than the execution time interval for which the controller 800 determines whether the execution condition of the standby mode is satisfied. FIG. 6 is a flowchart depicting the monitoring processing. First, the controller 800 determines whether the detected temperature is equal to or greater than a low-temperature threshold value (S510). The low-temperature threshold value is a temperature lower than the standby temperature when it is determined that the detected temperature is not equal to or greater than the low-temperature threshold value, i.e., the detected temperature is less than the low-temperature threshold value (S510: NO), the controller 800 executes the usual on-off processing (S520), in preference to the variation reduction processing, and returns to S510. That is, during the execution of the variation reduction processing, for example, during at least one of the first time period and the second time period, when the detected temperature becomes less than the low-temperature threshold value, the controller 800 switches the variation reduction processing to the usual on-off processing by an interrupt. In the meantime, the usual on-off processing is basically the same as the processing of S130. However, when the printing mode is being executed, the target temperature Tt is a fixing temperature, and when the standby mode is being executed, the target temperature Tt is the standby temperature.

When it is determined in S510 that the detected temperature is equal to or greater than the low-temperature threshold value (YES), the controller 800 determines whether the detected temperature is less than a high-temperature threshold value (S530). The high-temperature threshold value is a temperature higher than the fixing temperature. When it is determined that the detected temperature is not less than the high-temperature threshold value, i.e., the detected temperature is equal to or greater than the high-temperature threshold value (S530: NO), the controller 800 stops the energization to the halogen heater 720 (S540), in preference to the variation reduction processing, and returns to S530. That is, during the execution of the variation reduction processing, for example, during the first time period, when the detected temperature becomes the high-temperature threshold value or greater, the controller 800 stops the energization to the halogen heater 720 by an interrupt.

When it is determined in S530 that the detected temperature is less than the high-temperature threshold value (S530: YES), the controller 800 ends the monitoring processing. On the other hand, when the detected temperature is equal to or greater than the low-temperature threshold value and is less than the high-temperature threshold value while the usual on-off processing is being executed in S520 in preference to the variation reduction processing, the controller 800 again returns to the variation reduction processing. Also, when the detected temperature is equal to or greater than the low-temperature threshold value and is less than the high-temperature threshold value after the energization to the halogen heater 720 is stopped in S540 in preference to the variation reduction processing, the controller 800 again returns to the variation reduction processing.

Herein, the temperature delay is described. As described above, the thermistor 770 is provided to detect the temperature of the halogen heater 720. However, in general, a so-called temperature delay that a change in the detected temperature on the basis of the signal from the temperature sensor such as the thermistor 770 with respect to an actual temperature change of a target such as the halogen heater 720 is delayed may occur. The temperature delay may be caused due to a variety of factors, for example, a design difficulty in arrangement of the temperature sensor under the same temperature environments as the target, a low responsiveness of the temperature sensor or a processing device configured to process a signal from the temperature sensor, and the like. In the illustrative embodiment, as shown in FIG. 1, since the halogen heater 720 and the thermistor 770 are disposed at positions spaced from each other, the temperature delay is likely to remarkably occur, particularly.

Figure 7:
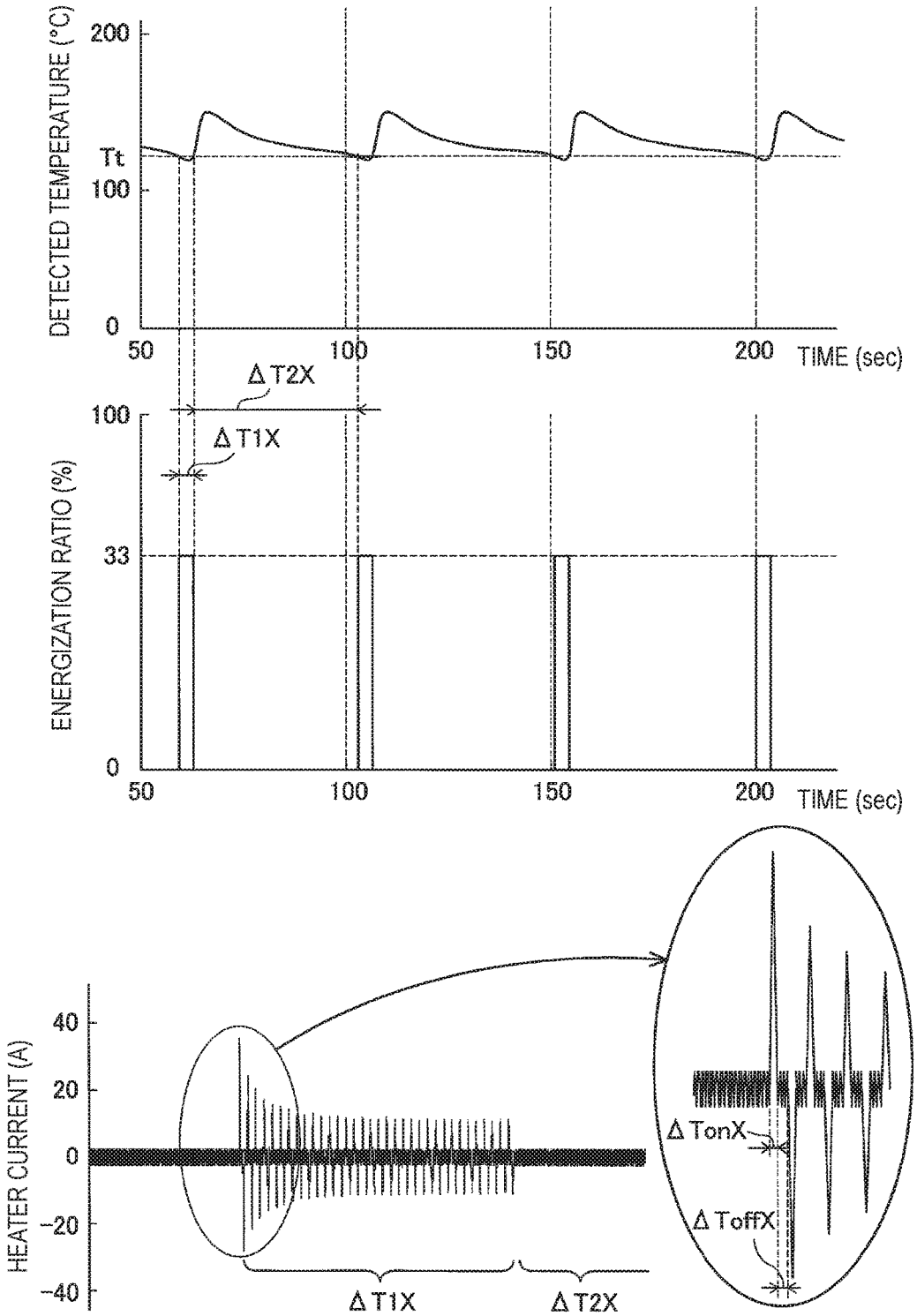
FIG. 7 is a time chart depicting changes in detected temperature, energization ratio and heater current in temperature control of a comparative example.

A relation between the temperature delay and the maximum relative voltage change (dmax) is described with reference to the temperature control of a comparative example. FIG. 7 is a time chart depicting changes in detected temperature, energization ratio and heater current when the temperature of the halogen heater 720 is controlled by the temperature control of the comparative example. The heater current is current that is to be output from the halogen heater 720. In FIG. 7, a time period ΔTonX is an energization time period ΔTon for which the halogen heater 720 is at the energization state, and a time period ΔToffX is a non-energization time period for which the halogen heater 720 is at the non-energization state. Also, a time period ΔT1X is a heat generation execution time period for which the halogen heater 720 executes the heat generation operation, and is longer than the on-off cycle. A time period ΔT2X is a heat generation stop time period for which the halogen heater 720 stops the heat generation operation, and is longer than the on-off cycle.

The temperature control of the comparative example is control of comparing magnitudes of the detected temperature and the target temperature Tt all the time, continuing the energization to the halogen heater 720 with the energization ratio of 33% for a time period in which the detected temperature is equal to or lower than the target temperature Tt and continuing to stop the energization to the halogen heater 720 for a time period in which the detected temperature exceeds the target temperature Tt, as shown in first and second upper time charts of FIG. 7 from above.

In the temperature control of the comparative example, after the detected temperature is equal to or lower than the target temperature Tt until the detected temperature exceeds the target temperature Tt, the energization to the halogen heater 720 with the energization ratio of 33% continues, so that the halogen heater 720 continues the heat generation operation. Therefore, even when the heater temperature reaches the target temperature Tt, if the detected temperature is equal to or lower than the target temperature Tt due to the temperature delay, the halogen heater 720 continues the heat generation operation. For this reason, an overshoot that the heater temperature highly exceeds the target temperature Tt occurs (refer to the first time chart of FIG. 7).

Thereafter, when the detected temperature exceeds the target temperature Tt, the energization to the halogen heater 720 is stopped, so that the halogen heater 720 stops the heat generation operation. However, since it takes much time until the heater temperature considerably higher than the target temperature Tt becomes the target temperature Tt or lower and it also takes much time until the detected temperature becomes the target temperature Tt or lower due to the temperature delay, the heat generation stop time period ΔT2X increases. As the heat generation stop time period ΔT2X increases, the heater temperature is considerably below the target temperature Tt and a resistance value of the halogen heater 720 relatively decreases. At this state, when the detected temperature becomes the target temperature Tt or lower and the energization to the halogen heater 720 is thus resumed, inrush current having a relatively large amplitude flows to the halogen heater 720, so that an amplitude of the heater current relatively increases (refer to a third time chart of FIG. 7 from above). Like this, in the temperature control of the comparative example, the variation in the heater temperature is great due to the temperature delay, so that the amplitude of the heater current from the halogen heater 720 is relatively large (refer to the third time chart of FIG. 7 from above). As a result, the maximum relative voltage change (dmax) also relatively increases.

Herein, as one method of reducing the maximum relative voltage change (dmax), there is a method of increasing the target temperature Tt. When the target temperature Tt is increased to maintain the temperature of the halogen heater 720 high, it is possible to maintain the resistance value of the halogen heater 720 high. Therefore, it is possible to reduce the inrush current upon the start of the energization to the halogen heater 720 and to reduce the maximum relative voltage change (dmax). However, for example, when the target temperature Tt is a fixing temperature, the fixing temperature is appropriately determined, considering the material of the sheet W and the like. Therefore, there are limitations on the increase in the target temperature Tt. Also, when the target temperature Tt is the standby temperature in the standby mode, it is particularly difficult to increase the target temperature Tt. Also, in the standby mode, as compared to the rotation state where the fixing belt 710 is being rotated, much heat from the halogen heater 720 is transmitted to the fixing belt 710, so that the fixing belt 710 is likely to be burned out. Meanwhile, in the illustrative embodiment, since the fixing belt 710 is configured by a belt of which heat capacity is less than a roller member, it is particularly likely to be burned out.

As another method of reducing the maximum relative voltage change (dmax), there is a method of shortening the heat generation stop time period ΔT2 of the halogen heater 720. When the heat generation stop time period ΔT2 is shortened, the difference between the target temperature Tt and the detected temperature due to the temperature delay is reduced. Therefore, the variation in the heater temperature is suppressed, so that the inrush current to the halogen heater 720 can be reduced and the maximum relative voltage change (dmax) can be thus reduced. However, when an execution cycle of the heat generation operation is shortened, a switching frequency of execution and stop of the energization to the halogen heater 720 increases, so that a ripple is generated and a flicker value may not be thus reduced. Therefore, according to this method, it is not possible to accomplish the reduction in the maximum relative voltage change (dmax) and the reduction in the flicker value at the same time.

Figure 8:
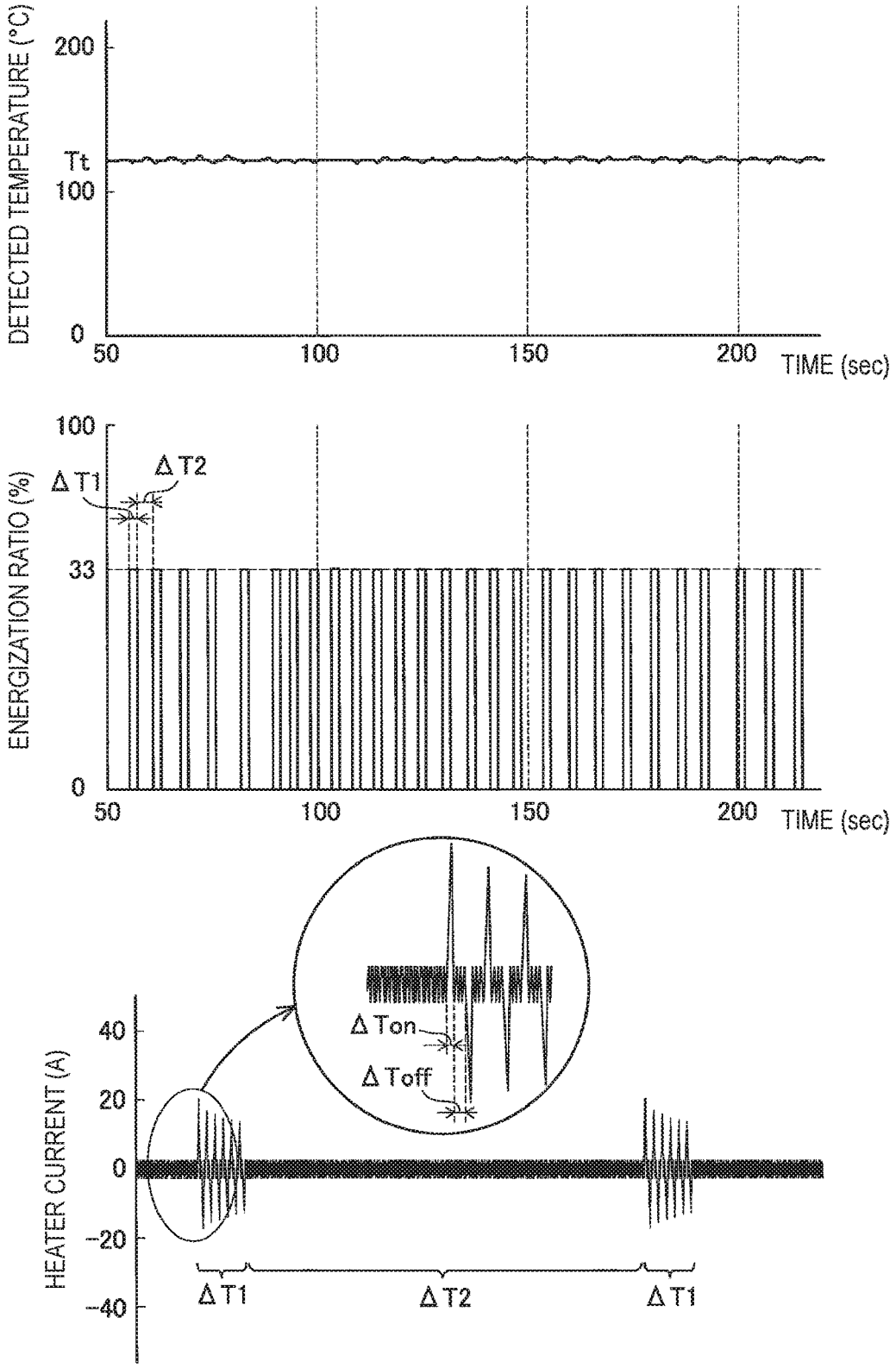
FIG. 8 is a time chart depicting changes in detected temperature, energization ratio and heater current in variation reduction control.

FIG. 8 is a time chart depicting changes in detected temperature, energization ratio and heater current when the temperature of the halogen heater 720 is controlled by the variation reduction control of the illustrative embodiment. In FIG. 8, a time period ΔTon is an energization time period for which the halogen heater 720 is at the energization state, and a time period ΔToff is a non-energization time period for which the halogen heater 720 is at the non-energization state. A time period ΔT1 is a heat generation execution time period for which the halogen heater 720 executes the heat generation operation, and is longer than the on-off cycle. A time period ΔT2 is a heat generation stop time period for which the halogen heater 720 stops the heat generation operation, and is longer than the on-off cycle.

According to the variation reduction control, a length of the heat generation execution time period ΔT1 is always constant and coincides with the first time period, and a length of the heat generation stop time period ΔT2 is secured at least by a length of the second time period, and is changed depending on a result of a follow-up determination as to whether the detected temperature is equal to or lower than the target temperature Tt.

Like this, according to the variation reduction control, as shown in second and third time charts of FIG. 8 from above, when the detected temperature becomes the target temperature it or lower (S310 of FIG. 5: YES), the energization to the halogen heater 720 with the fixed energization ratio of 33% is performed for the first time period (S340, S350), irrespective of the difference between the detected temperature and the target temperature Tt, and then the energization to the halogen heater 720 is stopped for the second time period (S360, S370), irrespective of the magnitude relation between the detected temperature and the target temperature Tt. That is, after it is determined that the detected temperature is equal to or lower than the target temperature Tt until the total time period of the first time period and the second time period elapses, the magnitude relation and difference between the detected temperature and the target temperature Tt are not reflected in the temperature control of the halogen heater 720.

Therefore, according to the variation reduction control, the overshoot that the heater temperature remarkably exceeds the target temperature Tt due to the temperature delay is suppressed (refer to the first time chart of FIG. 8 from above), as compared to the temperature control of the comparative example where the energization to the halogen heater 720 continues until the detected temperature exceeds the target temperature Tt. The overshoot is suppressed, so that the heat generation stop time period ΔT2 of the variation reduction control becomes shorter than the heat generation stop time period ΔT2X of the temperature control of the comparative example (refer to the second time chart of FIG. 8 from above). Therefore, a situation where the heater temperature considerably falls short of the target temperature Tt is suppressed and a situation where the resistance value of the halogen heater 720 is relatively reduced is also suppressed. Thereby, when the energization to the halogen heater 720 is resumed, the inrush current flowing to the halogen heater 720 is reduced. In this way, according to the variation temperature control, it is possible to suppress the variation in the heater temperature due to the temperature delay without increasing the target temperature it and to suppress the inrush current having a relatively great amplitude from flowing to the halogen heater 720, so that it is possible to reduce the maximum relative voltage change (dmax). Also, according to the variation temperature control, since it is not necessary to shorten the heat generation stop time period of the halogen heater 720, it is possible to reduce the flicker value, too.

Like the standby mode, during the execution of stop heating where the fixing belt 710 is heated with the fixing belt 710 being stationary, the temperature of the halogen heater 720 is maintained at a relatively low temperature so as to avoid the burnout of the fixing belt 710 and the like. When the temperature of the halogen heater 720 is maintained at a relatively low temperature, the maximum relative voltage change (dmax) is likely to increase due to the inrush current, which flows upon the energization of the halogen heater 720. However, according to the illustrative embodiment, even when the stop heating is being executed, it is possible to reduce the maximum relative voltage change (dmax) by executing the variation reduction control (refer to FIG. 8).

For the first time period of the variation reduction control, the halogen heater 720 is energized with the energization ratio of one value (S340 of FIG. 5). Thereby, as compared to a configuration where the halogen heater 720 is energized with a plurality of energization ratios of preset multiple values, it is possible to reduce the processing load of the controller 800 in the variation reduction control. Also, the one value is 33%. Thereby, it is possible to reduce the flicker value, as compared to a configuration where the energization ratio of another value is used.

Also, the length of the first time period is constant, irrespective of the difference between the detected temperature and the target temperature Tt. Thereby, as compared to a configuration where the first time period is changed in correspondence to the difference between the detected temperature and the target temperature Tt, the variation in temperature of the halogen heater 720 due to the variation in the difference between the detected temperature and the target temperature Tt is suppressed, so that it is possible to reduce the maximum relative voltage change (dmax). Also, since the second time period is longer than the third time period, the variation in the heater temperature due to the variation in the difference between the detected temperature and the target temperature Tt is suppressed, as compared to a configuration where the second time period is shorter than the third time period. As a result, it is possible to reduce the maximum relative voltage change (dmax). Also, the total time period of the first time period and the second time period and is 0.5 second or longer and 2.0 seconds or shorter. Thereby, it is possible to more securely reduce the maximum relative voltage change (dmax).

In the monitoring processing of FIG. 6, when it is determined that the detected temperature is less than the low-temperature threshold value (S510: NO), the usual on-off processing is executed in preference to the variation reduction processing (S520). Thereby, for at least one of the first time period and the second time period, it is possible to suppress a situation, in which the heater temperature is less than the low-temperature threshold value smaller than the target temperature Tt, from continuing for a long time period. Also, when it is determined that the detected temperature is equal to or greater than the high-temperature threshold value (S530: NO), the energization to the halogen heater 720 is stopped in preference to the variation reduction processing (S540). Thereby, for the first time period, it is possible to suppress the heat generation operation from continuing even though the heater temperature is equal to or greater than the high-temperature threshold value greater than the target temperature Tt.

Figure 9:
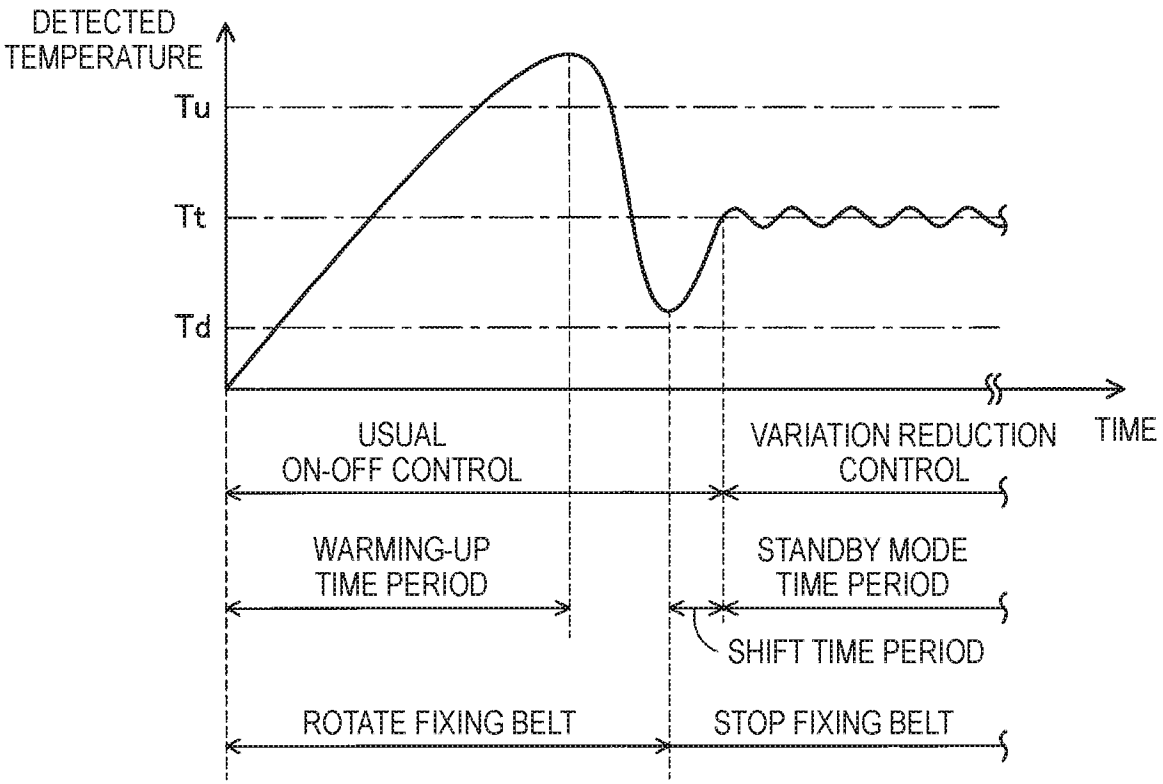
FIG. 9 is a time chart depicting a change in detected temperature for a warming-up time period, a shift time period and a standby mode time period.

FIG. 9 is a time chart depicting a change in detected temperature for a warming-up time period, a shift time period and a standby mode time period. As shown in FIG. 9, in the illustrative embodiment, for the warming-up time period from the start of the printer 10 and the shift time period (rotation heating time period for which the fixing belt 710 rotates), the usual on-off control is executed (S120 of FIG. 4: NO, S130), and for the standby mode time period (stop heating time period for which the fixing belt 710 is stationary), the variation reduction control is executed (S120 of FIG. 4: YES, S140). Thereby, for the warming-up time period and the shift time period, it is possible to bring the detected temperature close to the target temperature Tt at an early stage, and for the standby mode time period, it is possible to reduce the maximum relative voltage change (dmax).

The technology of the disclosure is not limited to the illustrative embodiment or modified embodiments to be described later, and can be implemented into a variety of configurations without departing from the gist of the disclosure.

In the above illustrative embodiment, the printer 10 of the laser exposure type configured to form a monochrome image has been exemplified as the image forming apparatus. However, the disclosure is not limited thereto. For example, the disclosure can also be applied to a color printer capable or forming an image. Also, the image forming apparatus is not limited to the printer and may be a copier, a complex machine or the like further having a document reading unit such as a scanner, in addition to the image forming unit. Also, the image forming apparatus is not limited to the laser printer and may be another electrophotographic image forming apparatus such as an LED printer.

Also, in the above illustrative embodiment, the halogen heater 720 has been exemplified as the heater. However, the disclosure is not limited thereto. For example, an infrared heater, a carbon heater or the like can also be adopted. Also, the heater is not limited to the configuration where the heater is fed with the power from the alternating current power supply and generates the heat, and may have a configuration where the heater is fed with the power from a direct current power supply and generates the heat. Also, in the above illustrative embodiment, the thermistor 770 has been exemplified as the temperature sensor. However, the disclosure is not limited thereto. For example, a thermostat or a temperature fuse can also be adopted.

Also, in the above illustrative embodiment, the fixing unit 700 is a belt-type (film type) fixing device having the fixing belt 710. However, the fixing unit 700 may be a roller-type fixing device having a roller.

In the above illustrative embodiment, the one CPU 810 has been exemplified as the controller. However, the disclosure is not limited thereto. For example, a configuration where a plurality of CPUs is included, a hardware circuit such as a CPU and an ASIC is included or only a hardware circuit is provided can also be adopted.

Also, in the processing (FIGS. 4 to 6) of the illustrative embodiment, some steps may be changed, some steps may be omitted or the sequence of some steps may be exchanged with other steps. For example, the determination condition of S120 of FIG. 4 may be replaced with a condition that the difference between the detected temperature and the target temperature Tt is equal to or smaller than a predetermined value, and the condition that the difference between the detected temperature and the target temperature Tt is equal to or smaller than a predetermined value may be further added to the determination condition of S120 of FIG. 4.

In the above illustrative embodiment, the first time period may be changed in correspondence to the difference between the detected temperature and the target temperature Tt, for example. Also, the variation reduction processing of FIG. 5 may be executed in the printing mode.

The energization ratio that is to be used in S340 of the variation reduction processing of FIG. 5 is not limited to 33%, and may be 75%, 67%, 57%, 43% or 25%. Also, in S340, the controller 800 may be configured to energize the halogen heater 720 with a plurality of energization ratios. For example, a preset energization ratio may be used, irrespective of the difference between the detected temperature and the target temperature Tt.

In the variation reduction processing of FIG. 5, the controller 800 may be configured to determine whether the detected temperature is equal to or lower than the target temperature Tt, even in the total time period of the first time period and the second time period. For example, it is sufficient when a determination result thereof is not reflected in the temperature control of the halogen heater 720.

Figure 10:
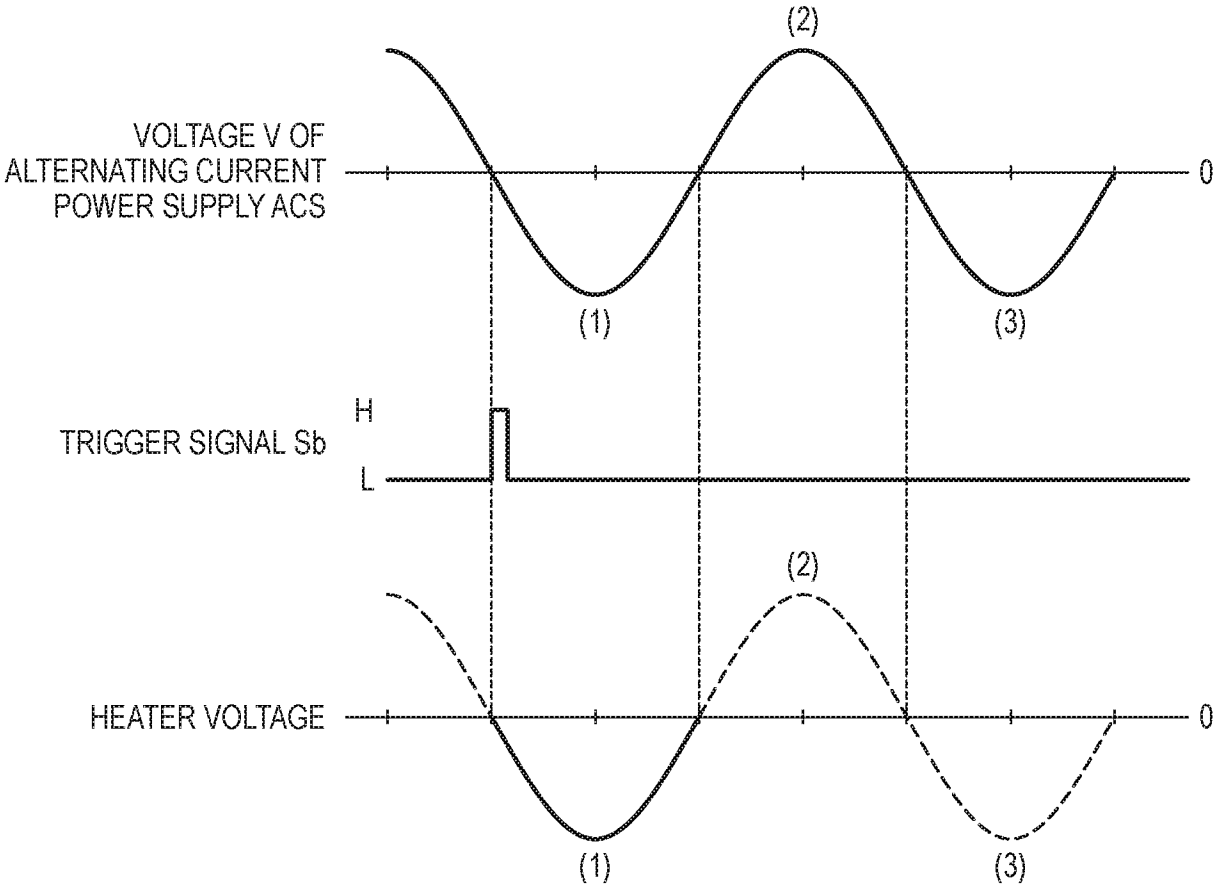
FIG. 10 is a time chart relating to a control of the heater in accordance with an alternative embodiment.

In the above illustrative embodiment, the energization ratio has been set based on a phase control shown in FIG. 3. However, the disclosure is not limited thereto, and the energization ratio can also be set by a wavenumber control as shown in FIG. 10. As exemplary shown in FIG. 10, a control in which one half-wave is lightened for each three half-waves results in a wavenumber control in which the energization ratio becomes 33%.

The details of the wavenumber control in which the energization ratio becomes 33% will be described with reference to FIG. 10.

The controller 800 changes the trigger signal Sb from a low level to a high level for a predetermined time period shortly after a zero-crossing of a half-wave (1) has been detected, by using a zero-cross signal output from the zero-cross signal generation circuit 930 as a reference. Accordingly, the halogen heater 720 is turned on (switched to the energization state) for a predetermined time period corresponding to the half-wave (1). Meanwhile, the controller 800 does not change the trigger signal Sb to the high level for a time period corresponding to a half-wave (2) and a half-wave (3) after the half-wave (1). Therefore, the halogen heater 720 is turned off (switched to the non-energization state) for a time period corresponding to the half-wave (2) and the half-wave (3). After the half-wave (3), the controller 800 similarly performs control such that the halogen heater 720 is turned on for one half-wave for each three half-waves. Accordingly, the wavenumber control in which the energization ratio becomes 33% is realized.

What is claimed is:

1. An image forming apparatus comprising:

a fixing device including a heater and a temperature sensor, and a controller configured to execute:

first heater control processing including:

first processing of driving the heater with a predetermined energization ratio for a first time period independently of a detected temperature of the temperature sensor wherein the predetermined energization ratio is an energization ratio of a wavenumber control;

second processing of stopping the driving of the heater for a second time period independently of the detected temperature of the temperature sensor, the second processing being executed when the first processing has ended;

comparison processing of comparing a detected temperature of the temperature sensor with a reference temperature, which is executed when the second processing has ended; and first determination processing of determining whether to execute the first processing again based on the result of the comparison processing which has been executed when the second processing ended;

second heater control processing of driving the heater based on the detected temperature of the temperature sensor for every control cycle shorter than the first time period; and second determination processing of determining whether the detected temperature of the temperature sensor is equal to or lower than a predetermined temperature or higher than the predetermined temperature, wherein:

in a case where the controller determines in the second determination processing that the detected temperature of the temperature sensor is higher than the predetermined temperature, the controller is configured to execute the first heater control processing, and in a case where the controller determines in the second determination processing that the detected temperature of the temperature sensor is equal to or lower than the predetermined temperature, the controller is configured to execute the second heater control processing, and wherein the comparison processing which is executed when the second processing has ended includes third determination processing of determining whether the detected temperature of the temperature sensor is equal to or lower than the reference temperature or higher than the reference temperature, wherein:

in a case where the controller determines in the third determination processing that the detected temperature is equal to or lower than the reference temperature, the controller is configured to execute the first processing, and in a case where the controller determines in the third determination processing that the detected temperature is higher than the reference temperature, the controller is configured to execute third processing of stopping the driving of the heater for a third time period independently of the detected temperature of the temperature sensor, the third time period being shorter than the second time period.

2. The image forming apparatus according to claim 1, wherein a length of the first time period is independent from the detected temperature of the temperature sensor and is constant.

3. The image forming apparatus according to claim 1, wherein, during the first time period, the controller is configured to drive the heater with a single energization ratio.

4. The image forming apparatus according to claim 3, wherein the single energization ratio is 33%.

5. The image forming apparatus according to claim 1, wherein a total time period of the first time period and the second time period is 0.5 seconds or longer and 2.0 seconds or shorter.

6. The image forming apparatus according to claim 1, wherein the controller is further configured to execute:

comparison processing of comparing a detected temperature of the temperature sensor with the reference temperature, when the third processing has ended, wherein the comparison processing which is executed when the third processing has ended includes fourth determination processing of determining whether the detected temperature of the temperature sensor is equal to or lower than the reference temperature or higher than the reference temperature, wherein, in a case where the controller determines in the fourth determination processing that the detected temperature is equal to or lower than the reference temperature, the controller is configured to execute the first processing, and wherein, in a case where the controller determines in the fourth determination processing that the detected temperature is higher than the reference temperature, the controller is configured to execute third processing of stopping the driving of the heater for the third time period independently of the detected temperature of the temperature sensor.

7. The image forming apparatus according to claim 1, wherein the controller is configured to further execute:

print processing of driving the heater so as to maintain the detected temperature of the temperature sensor to a first target temperature for heat-fixing developer on a recording sheet; and standby processing of driving the heater so as to maintain the detected temperature of the temperature sensor to a second target temperature lower than a first target temperature, and wherein the controller is configured to execute the first heater control processing while the standby processing is being executed.

8. The image forming apparatus according to claim 1, wherein the fixing device includes a roller configured to convey a recording sheet, wherein the controller is configured to selectively execute driving and stopping of the roller, and wherein the controller is configured to execute the first heater control processing while the roller is being stopped.

9. An image forming apparatus comprising:

a fixing device including a heater and a temperature sensor, and a controller configured to execute:

first heater control processing including:

first processing of driving the heater with a predetermined energization ratio for a first time period independently of a detected temperature of the temperature sensor, wherein the predetermined energization ratio is an energization ratio of a wavenumber control;

second processing of stopping the driving of the heater for a second time period independently of the detected temperature of the temperature sensor, the second processing being executed when the first processing has ended;

comparison processing of comparing a detected temperature of the temperature sensor with a reference temperature, which is executed when the second processing has ended; and first determination processing of determining whether to execute the first processing again based on the result of the comparison processing which has been executed when the second processing ended;

second heater control processing of driving the heater based on the detected temperature of the temperature sensor for every control cycle shorter than the first time period;

second determination processing of determining whether the detected temperature of the temperature sensor is equal to or lower than a predetermined temperature or higher than the predetermined temperature, wherein:

in a case where the controller determines in the second determination processing that the detected temperature of the temperature sensor is higher than the predetermined temperature, the controller is configured to execute the first heater control processing, and in a case where the controller determines in the second determination processing that the detected temperature of the temperature sensor is equal to or lower than the predetermined temperature, the controller is configured to execute the second heater control processing;

print processing of driving the heater so as to maintain the detected temperature of the temperature sensor to a first target temperature for heat-fixing developer on a recording sheet; and standby processing of driving the heater so as to maintain the detected temperature of the temperature sensor to a second target temperature lower than a first target temperature, wherein the controller is configured to execute the first heater control processing while the standby processing is being executed.

10. The image forming apparatus according to claim 9, wherein a length of the first time period is independent from the detected temperature of the temperature sensor and is constant.

11. The image forming apparatus according to claim 9, wherein, during the first time period, the controller is configured to drive the heater with a single energization ratio.

12. The image forming apparatus according to claim 11, wherein the single energization ratio is 33%.

13. An image forming apparatus comprising:

a fixing device including a heater and a temperature sensor, wherein the fixing device includes a roller configured to convey a recording sheet; and a controller configured to execute:

selective driving and stopping of the roller;

first heater control processing while the roller is being stopped, the first heater control processing including:

first processing of driving the heater with a predetermined energization ratio for a first time period independently of a detected temperature of the temperature sensor, wherein the predetermined energization ratio is an energization ratio of a wavenumber control;

second processing of stopping the driving of the heater for a second time period independently of the detected temperature of the temperature sensor, the second processing being executed when the first processing has ended;

comparison processing of comparing a detected temperature of the temperature sensor with a reference temperature, which is executed when the second processing has ended; and first determination processing of determining whether to execute the first processing again based on the result of the comparison processing which has been executed when the second processing ended;

second heater control processing of driving the heater based on the detected temperature of the temperature sensor for every control cycle shorter than the first time period;

second determination processing of determining whether the detected temperature of the temperature sensor is equal to or lower than a predetermined temperature or higher than the predetermined temperature, wherein:

in a case where the controller determines in the second determination processing that the detected temperature of the temperature sensor is higher than the predetermined temperature, the controller is configured to execute the first heater control processing, and in a case where the controller determines in the second determination processing that the detected temperature of the temperature sensor is equal to or lower than the predetermined temperature, the controller is configured to execute the second heater control processing.

14. The image forming apparatus according to claim 13, wherein a length of the first time period is independent from the detected temperature of the temperature sensor and is constant.

15. The image forming apparatus according to claim 13, wherein, during the first time period, the controller is configured to drive the heater with a single energization ratio.

16. The image forming apparatus according to claim 15, wherein the single energization ratio is 33%.

* * * * *